US006420078B1

(12) United States Patent
Ciccarelli et al.

(10) Patent No.: US 6,420,078 B1
(45) Date of Patent: Jul. 16, 2002

(54) TONER COMPOSITIONS WITH SURFACE ADDITIVES

(75) Inventors: Roger N. Ciccarelli, Rochester; Denise R. Bayley, Fairport; Thomas R. Pickering, Webster; Andrew Furman, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/749,687

(22) Filed: Dec. 28, 2000

(51) Int. Cl.[7] ..... G03G 9/08

(52) U.S. Cl. ..... 430/108.3; 430/108.6; 430/137.1

(58) Field of Search ..... 430/108.6, 108.3, 430/137.1

(56) References Cited

U.S. PATENT DOCUMENTS

| | | | | |
|---|---|---|---|---|
| 1,442,835 | A | | 1/1923 | Surplus |
| 2,871,233 | A | | 1/1959 | Pfitzner et al. |
| 2,891,938 | A | | 6/1959 | Schetty |
| 2,891,939 | A | | 6/1959 | Schetty |
| 2,933,489 | A | | 4/1960 | Biedermann et al. |
| 2,986,521 | A | | 5/1961 | Wielicki |
| 3,590,000 | A | | 6/1971 | Palermiti et al. |
| 3,893,935 | A | | 7/1975 | Jadwin et al. |
| 3,900,588 | A | | 8/1975 | Fisher |
| 3,944,493 | A | | 3/1976 | Jadwin et al. |
| 4,007,293 | A | | 2/1977 | Mincer et al. |
| 4,053,462 | A | | 10/1977 | Beffa et al. |
| 4,079,014 | A | | 3/1978 | Burness et al. |
| 4,206,064 | A | | 6/1980 | Kiuchi et al. |
| 4,221,856 | A | | 9/1980 | Lu |
| 4,265,990 | A | | 5/1981 | Stolka et al. |
| 4,291,111 | A | | 9/1981 | Lu |
| 4,298,672 | A | | 11/1981 | Lu |
| 4,312,933 | A | | 1/1982 | Lu |
| 4,314,937 | A | | 2/1982 | Beffa |
| 4,338,390 | A | | 7/1982 | Lu |
| 4,394,430 | A | | 7/1983 | Jadwin et al. |
| 4,404,271 | A | | 9/1983 | Kawagishi et al. |
| 4,411,974 | A | | 10/1983 | Lu et al. |
| 4,433,040 | A | | 2/1984 | Niimura et al. |
| 4,558,108 | A | | 12/1985 | Alexandru et al. |
| 4,560,635 | A | | 12/1985 | Hoffend et al. |
| 4,563,408 | A | | 1/1986 | Lin et al. |
| 4,584,253 | A | | 4/1986 | Lin et al. |
| 4,585,884 | A | | 4/1986 | Lin et al. |
| 4,883,736 | A | | 11/1989 | Hoffend et al. |
| 4,904,762 | A | | 2/1990 | Chang et al. |
| 4,935,326 | A | | 6/1990 | Creatura et al. |
| 4,937,166 | A | | 6/1990 | Creatura et al. |
| 5,223,368 | A | | 6/1993 | Ciccarelli et al. |
| 5,304,449 | A | | 4/1994 | Hollenbaugh et al. |
| 5,352,556 | A | | 10/1994 | Mahabadi et al. |
| 5,707,770 | A | * | 1/1998 | Tanikawa et al. ..... 430/108.6 |
| 5,827,632 | A | * | 10/1998 | Inaba et al. ..... 430/108.6 |
| 6,004,714 | A | | 12/1999 | Ciccarelli et al. |
| 6,017,668 | A | | 1/2000 | Young et al. |
| 6,071,665 | A | | 6/2000 | Dickerson et al. |
| 6,087,059 | A | | 7/2000 | Duggan et al. |
| 6,103,440 | A | | 8/2000 | Lohr |
| 6,124,071 | A | | 9/2000 | Lin et al. |
| 6,203,960 | B1 | * | 3/2001 | Ciccarelli et al. ..... 430/108.7 |
| 6,265,126 | B1 | * | 7/2001 | Nishihara et al. ..... 430/108.6 |

OTHER PUBLICATIONS

Diamond, Arthur S. Handbook of Imaging Materials. New York: Marcel–Dekker, Inc. p. 169. (1991).*

* cited by examiner

*Primary Examiner*—Christopher Rodee
(74) *Attorney, Agent, or Firm*—Oliff & Berridge, PLC

(57) ABSTRACT

A toner composition includes a binder, a colorant, and a treated alumina, wherein the treated alumina includes alumina particles treated with a treatment agent. The treatment agent can be, for example, an alkylalkoxysilane such as decyltrimethoxysilane.

14 Claims, 4 Drawing Sheets

TONER COMPOSITIONS WITH SURFACE ADDITIVES

BACKGROUND OF THE INVENTION

1. Field of Invention

The present invention relates to toner compositions having improved properties that are provided by improved surface additives. More particularly, the present invention relates to toner and developer compositions where the toner particles have an improved treated alumina surface additive.

2. Description of Related Art

In electrophotography, a photoreceptor containing a photoconductive insulating layer on a conductive layer is imaged by first uniformly electrostatically charging its surface. The photoreceptor is then exposed to a pattern of activating electromagnetic radiation, such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided toner particles on the surface of the photoconductive insulating layer. The resulting visible image may then be transferred from the photoconductor to a support, such as transparency or paper. This imaging process may be repeated many times.

Various toner compositions for such a printing system are well known in the art, and have been produced having a wide range of additives and constituent materials. Generally, however, the toner particles include a binding material such as a resin, a colorant such as a dye and/or a pigment, and any of various additives to provide particular properties to the toner particles.

One type of additive that is commonly used in toner compositions is a surface additive. The surface additive can be incorporated for any of various reasons, including for providing improved charging characteristics, improved flow properties, and the like.

For example, toner compositions with certain surface additives, including certain silicas, are known. Examples of these additives include colloidal silicas, such as certain AEROSILS like R972™ available from Degussa, metal salts and metal salts of fatty acids inclusive of zinc stearate, aluminum oxides, cerium oxides, and mixtures thereof. Generally, such additives are each present in an amount of from about 1 percent by weight to about 5 percent by weight, and preferably in an amount of from about 1 percent by weight to about 3 percent by weight, of the toner composition. Several of the aforementioned additives are illustrated, for example, in U.S. Pat. Nos. 3,590,000 and 3,900,588, the entire disclosures of which are incorporated herein by reference.

Also known are toners containing a mixture of hexamethyldisilazane (HMDZ) and aminopropyltriethoxysilane (APTES). Disadvantages associated with these toners may include, in certain instances, a low, relatively unstable triboelectric charge, and high relative humidity sensitivity. Further, disadvantages of toners containing as surface additives HMDZ include, for example, unstable triboelectric charge, relative humidity sensitivity, and low charge/wrong sign toner as measured by a charge spectrograph.

Developer compositions with charge enhancing additives, which impart a positive charge to the toner resin, are also known. For example, U.S. Pat. No. 3,893,935 describes the use of quaternary ammonium salts as charge control agents for electrostatic toner compositions. U.S. Pat. No. 4,221,856 discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens, such as iodide, chloride and bromide. Similar teachings are presented in U.S. Pat. Nos. 4,312,933 and 4,291,111. There is also described in U.S. Pat. No. 2,986,521 developer compositions comprised of toner resin particles coated with certain finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the entire disclosure of which is incorporated herein by reference, developer compositions containing as charge enhancing additives organic sulfate and sulfonates, which additives can impart a positive charge to the toner composition. Further, there is disclosed in U.S. Pat. No. 4,298,672, the entire disclosure of which is incorporated herein by reference, positively charged toner compositions with resin particles and pigment particles, and as charge enhancing additives alkyl pyridinium compounds. Additionally, other patents disclosing positively charged toner compositions with charge control additives include, for example, U.S. Pat. Nos. 3,944,493; 4,007,293; 4,079,014; 4,394,430 and 4,560,635, which illustrate a toner with a distearyl dimethyl ammonium methyl sulfate charge additive. Surface additives, such as silicas like AEROSILS, may be incorporated into the toners of these patents.

Moreover, toner compositions with negative charge enhancing additives are known, as described, for example, in U.S. Pat. Nos. 4,411,974 and 4,206,064, the entire disclosures of which are incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

U.S. Pat. No. 4,404,271 describes a toner that contains a metal complex where the metal can be chromium, cobalt or iron. Additionally, other patents disclosing various metal containing azo dyestuff structures wherein the metal is chromium or cobalt include U.S. Pat. Nos. 2,891,939, 2,871,233, 2,891,938, 2,933,489, 4,053,462 and 4,314,937. Also, in U.S. Pat. No. 4,433,040, the entire disclosure of which is incorporated herein by reference, there are illustrated toner compositions with chromium and cobalt complexes of azo dyes as negative charge enhancing additives. Other charge enhancing additives include those illustrated in U.S. Pat. Nos. 5,304,449, 4,904,762, and 5,223,368, the entire disclosures of which are incorporated herein by reference.

Despite the broad range of additives that have been used in formulating toner compositions, there is a continued need in the art for improved toner compositions that provide improved results and improved image quality.

For example, U.S. Pat. No. 6,124,071 discloses toner compositions including a polymer and titanium oxide dihydroxide of the formula —O—$Ti(OH)_2$. The titanium oxide dihydroxide is a charge additive. U.S. Pat. No. 6,087,059 describes a toner comprised of resin, colorant and a surface additive mixture comprised of two coated silicas, and a coated metal oxide. U.S. Pat. No. 6,017,668 discloses a toner composition comprising resin, colorant, and a surface additive mixture of a magnetite and a polyvinylidene fluoride. U.S. Pat. No. 6,004,714 discloses a toner comprised of binder, colorant, and a silica containing a coating of an alkylsilane, including polyalkylsilanes such as decylsilane. Each of the toner compositions are disclosed as providing a number of advantages, such as excellent triboelectric charging characteristics, substantial insensitivity to humidity, superior toner flow through, stable triboelectric charging values, and wherein the toners enable the generation of developed images with superior resolution, and excellent color intensity.

SUMMARY OF THE INVENTION

Despite these and other various toner composition formulations, there remains a need in the art for improved toner compositions. For example, although various of the above-described surface additives have provided improved printing and processing characteristics, some of the additives possess certain drawbacks that preferably should be overcome to provide still further improved performance results.

For example, although titanium dioxide (titania), either by itself or in surface treated forms, has been widely used in the art, such a surface additive introduces several problems. In particular, both treated and untreated forms of titania tend to reduce the triboelectric charge of the toner composition. In addition, the titania additives have a higher refractive index (about 2.4 to 2.5) as compared to the polymer resins used to form the toner particles (about 1.5 to 1.7). As a result, the titania causes a higher light scattering, which hurts color toners in both the reflection and transmission modes. Based on both of these drawbacks, the loading amount of the titania must be reduced as much as possible, as higher loadings only exacerbate the problems.

The present invention addresses these problems by using, as a toner particle surface additive, a treated $Al_2O_3$ (aluminum oxide or alumina). Use of the treated alumina provides significant benefits to the toner compositions. Unlike titania, the treated alumina does not cause a reduction in the triboelectric charge of the toner composition. Furthermore, because alumina has a lower refractive index (about 1.7), which more closely matches the refractive index of the polymer resins used to form the toner particles, the use of treated alumina allows for a higher loading of the material, without increased light scattering.

In particular, the present invention provides a toner composition comprising:

a binder, a colorant, and a treated alumina as a surface additive, wherein said treated alumina comprises alumina particles treated with a treatment agent.

The present invention also provides developers including such a toner composition, and methods for making such a toner composition.

BRIEF DESCRIPTION OF THE DRAWINGS

These and other advantages and features of this invention will be apparent from the following, especially when considered with the accompanying drawings, in which.

DETAILED DESCRIPTION OF PREFERRED EMBODIMENTS

Figure 1:
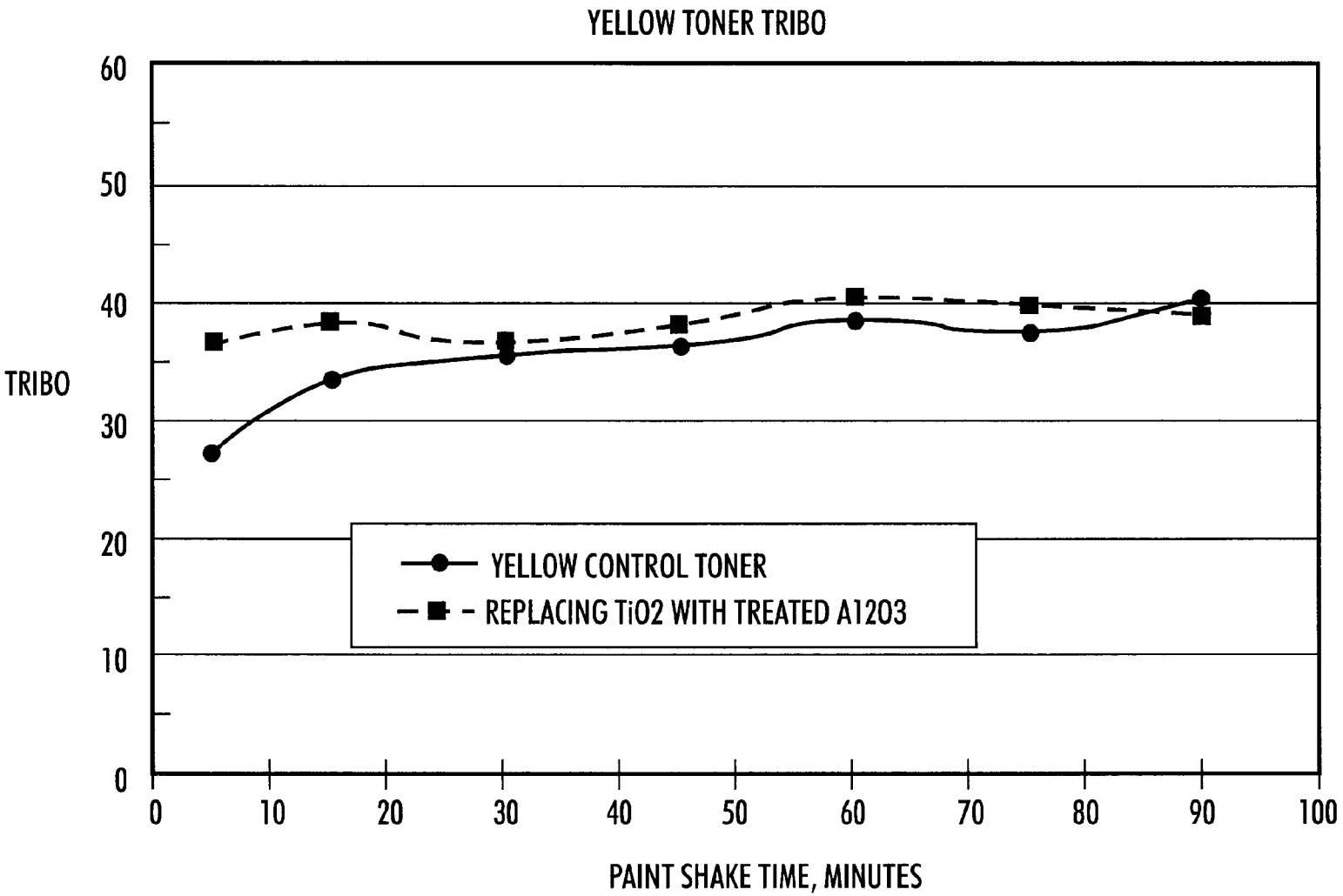
FIG. 1 shows triboelectric charge tracks for a yellow developer of the present invention compared to a conventional yellow developer.

According to the present invention, a toner is provided that includes at least a binder, a colorant, and a surface additive. The surface additive is $Al_2O_3$ (aluminum oxide or alumina) that is surface treated, preferably by an alkylalkoxysilane.

As the base material for the surface additive, any suitable alumina material can be used, such as those available from Cabot Corporation. Preferably, the alumina has a primary particle size of from about 20 or about 25 nanometers to about 55 or about 60 nanometers. More preferably, the primary particle size is from about 30 nanometers to about 40 nanometers. Because the alumina is typically used as larger particles that are aggregates of the smaller primary particles, the alumina particles according to the present invention preferably have an average aggregate size of from about 200 or about 225 nanometers to about 400 or about 450 nanometers. More preferably, the average aggregate size is from about 300 nanometers to about 375 nanometers. However, alumina materials having sizes outside of these ranges can be used, in embodiments.

The treatment agent used to treat the alumina particles according to the invention is preferably an alkylsilane, alkoxysilane, or alkylalkoxysilane. More preferably the treatment agent is an alkylalkoxysilane.

When alkylalkoxysilanes are used as the treatment agent, the alkyl group of the silane preferably contains from 1 to about 25 carbon atoms, preferably from about 4 to about 18 carbon atoms. For example, suitable alkyl groups include, but are not limited to, butyl, hexyl, octyl, decyl, dodecyl, or stearyl (octadecanyl). When alkoxysilanes are used as the treatment agent, the alkoxy group of the silane preferably contains from 1 to about 10 carbon atoms.

In embodiments, the alkylalkoxysilane can be represented by the following formula (I):

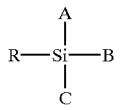

wherein R represents an alkyl group and A, B, and C independently represent alkoxy groups.

Examples of preferred treatment agents thus include, but are not limited to, decyltrialkoxysilane such as decyltrimethoxysilane, and octyltrialkoxysilane such as octyltriethoxysilane. Other suitable treatment agents can also be used.

The treatment agent can be present on the alumina particles in any suitable amount to provide desired results. In embodiments, the treatment agent is present in an amount of from about 2 to about 25 percent by weight, based on the weight of the alumina particles. Preferably, the treatment agent is present in an amount of from about 5 to about 20 percent by weight, and more preferably from about 10 to about 20 percent by weight, based on the weight of the alumina particles. However, values outside these ranges can be used, in embodiments.

Generally, the amount of the treatment agent on the alumina surface can be determined from and/or controlled by the feed rate or feed amount of a precursor material, such as an alkylalkoxysilane. In embodiments, to achieve the desired treatment level, the feed amount of the precursor material is from about 1 or about 2.5 to about 25 or about 30 weight percent of the alumina. Preferably, the feed amount of the precursor material is from about 5 to about 20 weight percent, more preferably from about 5 to about 15 weight percent.

The treated alumina particles preferably have a primary particle size as determined from BET, of, for example, from about 10 or about 20 nanometers to about 400 or about 500 nanometers. Preferably, the particle size is from about 25 nanometers to about 100 nanometers, or from about 25 nanometers to about 55 nanometers. The BET measurement method is named for Brunauer, Emmett, and Teller, and is a standard known technical method that measures surface area, and with model assumptions can calculate the primary particle size.

The thus formed treated alumina particles can be added to the toner composition in any suitable amount to obtain the desired results. In embodiments, the treated alumina is present on the surface of the toner particles in an amount of from about 0.5 to about 10 percent by weight, based on the weight of the toner particles. Preferably, the treated alumina is present in an amount of from about 1 to about 5 percent by weight, based on the weight of the toner particles. However, values outside these ranges can be used, in embodiments.

The toner compositions of the present invention, in addition to including the above-described surface additive, generally also include at least a toner resin and a colorant. In addition, the toner compositions can include one or more conventional additives, including but not limited to, optional charge enhancing additives and optional waxes, especially low molecular weight waxes with an Mw of, for example, from about 1,000 to about 20,000. Suitable toner compositions, which can be modified to include the treated alumina surface additive of the present invention, include those toner compositions disclosed in, for example, U.S. Pat. Nos. 6,004,714, 6,017,668, 6,071,665, 6,087,059, 6,103,440, and 6,124,071, the entire disclosures of which are incorporated herein by reference. The toner compositions can generally be prepared by any known technique, such as by admixing and heating resin particles, colorant, and optional additives other than the above-described surface additive in a suitable toner extrusion device, such as the ZSK53 available from Werner Pfleiderer, following by removing the formed toner composition from the device. Subsequent to cooling, the toner composition is subjected to grinding utilizing, for example, a Sturtevant micronizer for the purpose of achieving toner particles with a desired volume median diameter of, for example, less than about 25 microns, and preferably of from about 6 to about 12 microns, which diameters are determined by a Coulter Counter. Subsequently, the toner compositions can be classified utilizing, for example, a Donaldson Model B classifier for the purpose of removing fines, that is toner particles having a volume median diameter of less than about 4 microns. Thereafter, the coated alumina particles and other optional surface additives can be added to the toner composition by blending the additives with the obtained toner particles.

As the toner (or binder) resin, any of the convention toner resins can be used. Illustrative examples of such suitable toner resins include, for example, thermoplastic resins such as vinyl resins in general or styrene resins in particular, and polyesters. Examples of suitable thermoplastic resins include, but are not limited to, styrene methacrylate; polyolefins; styrene acrylates, such as PSB-2700 obtained from Hercules-Sanyo Inc.; polyesters, styrene butadienes; crosslinked styrene polymers; epoxies; polyurethanes; vinyl resins, including homopolymers or copolymers of two or more vinyl monomers; and polymeric esterification products of a dicarboxylic acid and a diol comprising a diphenol. Other suitable Vinyl monomers include, but are not limited to, styrene; p-chlorostyrene; unsaturated mono-olefins such as ethylene, propylene, butylene, isobutylene and the like; saturated mono-olefins such as vinyl acetate, vinyl propionate, and vinyl butyrate; vinyl esters such as esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, and acrylamide; mixtures thereof; and the like. In addition, crosslinked resins, including polymers, copolymers, and homopolymers of styrene polymers, may be selected.

For example, as one toner resin, there can be selected the esterification products of a dicarboxylic acid and a diol comprising a diphenol. These resins are illustrated, for example, in U.S. Pat. No. 3,590,000, the entire disclosure of which is incorporated herein by reference. Other specific toner resins include, but are not limited to, styrene/methacrylate copolymers, and styrene/butadiene copolymers; Pliolites; suspension polymerized styrene butadienes, reference U.S. Pat. No. 4,558,108, the entire disclosure of which is incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol; reactive extruded resins, especially reactive extruded polyesters with crosslinking as illustrated in U.S. Pat. No. 5,352,556, the entire disclosure of which is incorporated herein by reference, styrene acrylates, and mixtures thereof. Also, waxes with a molecular weight Mw of from about 1,000 to about 20,000, such as polyethylene, polypropylene, and paraffin waxes, can be included in, or on the toner compositions as fuser roll release agents.

The toner resin is generally present in any sufficient, but effective amount. For example, the toner resin is generally present in an amount of from about 50 to about 95 percent by weight of the toner composition. More preferably, the toner resin is generally present in an amount of from about 70 to about 90 percent by weight of the toner composition.

The toner composition also generally includes a colorant. As desired, the colorant can be a dye, a pigment, a mixture of a dye and a pigment, or two or more of them. As colored pigments, there can be selected, for example, various known cyan, magenta, yellow, red, green, brown, or blue colorants, or mixtures thereof. Specific examples of pigments include, but are not limited to, phthalocyanine HELIOGEN BLUE L6900™, D6840™, D7080™, D7020™, PYLAM OIL BLUE™, PYLAM OIL YELLOW™, PIGMENT BLUE 1™, available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, CINQUASIA MAGENTATA™ available from E.I. DuPont de Nemours & Company, Pigment Yellow 180, Pigment Yellow 12, Pigment Yellow 13, Pigment Yellow 14, Pigment Yellow 17, Pigment Blue 15, Pigment Blue 15:3, Pigment Red 122, Pigment Red 57:1, Pigment Red 81:1, Pigment Red 81:2, Pigment Red 81:3, and the like.

Generally, colored dyes and pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like. Illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Other soluble dyes, such as red, blue, green, and the like, can also be used, as desired.

Generally, the colorant is included in the toner composition in known amounts, for the desired color strength. For example, the above-described dyes and pigments, and others, can be included in the toner composition in any suitable amount, such as from about 1 to about 20 percent by weight of the toner composition. Preferably, the colorant is included in an amount of from about 2 to about 10 percent by weight of the toner composition.

If desired, such as to give the toner composition magnetic properties, magnetites can also be included in the toner composition, either for their magnetic properties, or for the colorant properties, or both. Suitable magnetites that can be used in the toner compositions of the present invention include, but are not limited to, a mixture of iron oxides ($FeO.Fe_2O_3$), including those commercially available as MAPICO BLACK™. The magnetite can be present in the toner composition in any of various effective amounts, such as an amount of from about 10 percent by weight to about 75 percent by weight of the toner composition. Preferably, the magnetite is present in an amount of from about 30 percent to about 55 percent by weight of the toner composition.

There can be included in the toner compositions of the present invention charge additives as indicated herein in various effective amounts, such as from about 1 to about 15, and preferably from about 1 to about 3, percent by weight of the toner composition. Such suitable charge additives can include the above-described coated alumina particles, or other charge additives well known in the art.

Furthermore, the toner compositions of the present invention can also include suitable waxes for their known effect. Suitable waxes include, but are not limited to, polypropylenes and polyethylenes commercially available from Allied Chemical and Petrolite Corporation; Epolene N-15 commercially available from Eastman Chemical Products, Inc.; Viscol 550-P, a low weight average molecular weight polypropylene available from Sanyo Kasei K.K.; mixtures thereof, and the like. The commercially available polyethylenes selected possess, for example, a weight average molecular weight of from about 1,000 to about 1,500, while the commercially available polypropylenes utilized are believed to have a weight average molecular weight of from about 4,000 to about 7,000. Many of the polyethylene and polypropylene compositions useful in the present invention are illustrated in British Patent No. 1,442,835, the entire disclosure of which is incorporated herein by reference.

The wax can be present in the toner composition of the present invention in various amounts. However, generally these waxes are present in the toner composition in an amount of from about 1 percent by weight to about 15 percent by weight, and preferably in an amount of from about 2 percent by weight to about 10 percent by weight, based on the weight of the toner composition.

The toners of the present invention may also, in embodiments, contain polymeric alcohols, such as UNILINS™, reference U.S. Pat. No. 4,883,736, the entire disclosure of which is incorporated herein by reference. The UNILINS™ products are available from Petrolite Corporation.

Developer compositions can be prepared by mixing the toners with known carrier particles, including but not limited to coated carriers, such as steel, ferrites, and the like, reference U.S. Pat. Nos. 4,937,166 and 4,935,326, the entire disclosures of which are incorporated herein by reference. The toner composition and carrier particles are generally mixed to include from about 2 percent toner concentration to about 8 percent toner concentration. The carriers can include coatings thereon, such as those illustrated in the above-referenced U.S. Pat. Nos. 4,937,166 and 4,935,326 patents, and other known coatings. There can be selected a single coating polymer, or a mixture of polymers. Additionally, the polymer coating or coatings may contain conductive components therein, such as carbon black in an amount for example, of from about 10 to about 70 weight percent, and preferably from about 20 to about 50 weight percent. Specific examples of coatings are fluorocarbon polymers, acrylate polymers, methacrylate polymers, silicone polymers, and the like.

Imaging methods are also envisioned with the toners of the present invention. Suitable imaging methods that utilize toner particles are known in the art and include, for example, but are not limited to, the various patents mentioned herein as well as U.S. Pat. Nos. 4,585,884, 4,584,253, 4,563,408, and 4,265,990, the entire disclosures of which are incorporated herein by reference.

The toner compositions prepared according to the present invention provide excellent results in electrostatographic printing operations. In particular, the toner compositions, including the treated aerosil particles, possess good triboelectric charge properties, good admix times, and substantially unimodal charge distributions.

In embodiments of the present invention, the toner compositions have a triboelectric charge of from about 15 to about 70 microcoulombs per gram. Preferably, the toner compositions have a triboelectric charge of from about 25 to about 65 microcoulombs per gram, more preferably from about 30 to about 60 microcoulombs per gram.

Likewise, In embodiments of the present invention, the toner compositions have an admix time of less than about 60 seconds. Preferably, the toner compositions have an admix time of less than about 45 seconds, more preferably from about 1 second to about 30 seconds.

An advantage of toner compositions according to the present invention, in embodiments, is that the toner compositions have a substantially unimodal charge distribution, as measured by a charge spectrograph. For example, toner compositions containing additives other than the treated alumina particles, or containing no additives, often exhibit charge distributions that have a distinct second peak, or a large shoulder on the primary peak in the charge distribution. In contrast, according to embodiments of the present invention, the toner compositions can be provided having a unimodal charge distribution and very little, or preferably none, low charge or wrong sign toner as measured by a charge spectrograph.

According to embodiments of the present invention, the charge spectrograph analyses of toners of the present invention exhibit improved charge distribution over conventional toners. That is, it has been found that in general toner compositions including the treated alumina additive provides a more unimodal charge distribution as compared to toner compositions including conventional additives such as titania. Moreover, it has been found that the charge distribution can be more easily adjusted than in the case of conventional toners, simply by adjusting the concentration of the alumina based on the surface treatment agent concentration. The present invention thereby provides further improvement in the adjustment of charge distribution for a toner composition.

The following examples illustrate specific embodiments of the present invention. One skilled in the art will recognize that the appropriate reagents, and component ratios/concentrations may be adjusted as necessary to achieve specific product characteristics. All parts and percentages are by weight unless otherwise indicated.

EXAMPLES

Comparative Example 1

Preparation of Yellow Toner

A toner is made by blending 73.33 weight percent of a polyester resin composed of bisphenol A and fumaric acid and 26.67 weight percent of a predispersion of the above mentioned polyester and Pigment Yellow 17 yellow pigment to give a final pigment concentration of 8 percent, and extruded in a ZSK-40 extruder. The extruded blend is then jetted and classified to form a yellow toner with a toner particle size of about 6.5 microns as measured in a Layson Cell. A thirty gram sample of this toner is added to a 9 ounce jar with 150 grams of stainless steel beads. To this is added 4.5 weight percent a 30 nanometer primary particle size fumed silica coated with decyltrimethoxysilane, available from Cabot Corp., 2.7 weight percent SMT5103, which is a 30 nanometer primary particle size titanium dioxide coated with decylsilane generated from decyltrimethoxysilane available from Tayca Corp., 0.3 weight percent H2050, which is a 12 nanometer primary particle size fumed silica commercially available from Wacker Chemie, and 0.5 weight percent zinc stearate L from Synthetic Products Company. After blending on a roll mill for 30 minutes the steel beads are removed from the jar.

Example 1

A yellow toner is prepared as in Comparative Example 1, except that the surface treated titania is replaced by a surface treated alumina, which is alumina treated with 15% decyltrimethoxysilane. The surface treated alumina is used in the same weight amount as the surface treated titania of Comparative Example 1.

Example 2 and Comparative Example 2

Developers are made using the toners of Example 1 and Comparative Example 1 by mixing 4 parts by weight of the foregoing blended toners with 100 parts by weight of a carrier of a Hoeganaes steel core, which core is previously coated with 1.0 weight percent of polymethylmethacrylate.

A 90-minute triboelectric charge track is made for each of the developers. The tracks are shown in FIG. 1. The triboelectric charge tracks show that the toner composition of the present invention, including a surface treated alumina, is at least as good as the toner of Comparative Example 1, not including the surface treated alumina.

Admix testing of each of the developers is also performed. In admix testing, fresh toner is added to the developer used to measure the tribo time tracks. Samples of the developer are analyzed at time intervals of 15 seconds, 60 seconds, and 120 seconds after a 0 time sample. The toner of Example 1 has very little wrong sign and low charge particles. This tests indicates the fresh toner's ability to charge the same as the old toner on the developer. Both the developers of Example 1 and Comparative Example 1 show high values of q/d (fc/$\mu$m) for their initial points of about 0.75 fc/$\mu$m. However, after the testing, the developer of Example 1 consistently shows better q/d values. By 120 seconds, the developer of Comparative Example 1 shows bimodal peaks with charge through, while the developer of Example 1 remains unimodal. The q/d value for Comparative Example 1 is 0.4, while the q/d value for Example 1 is about 0.51.

Examples 3–8 and Comparative Example 3–8

Figure 2:
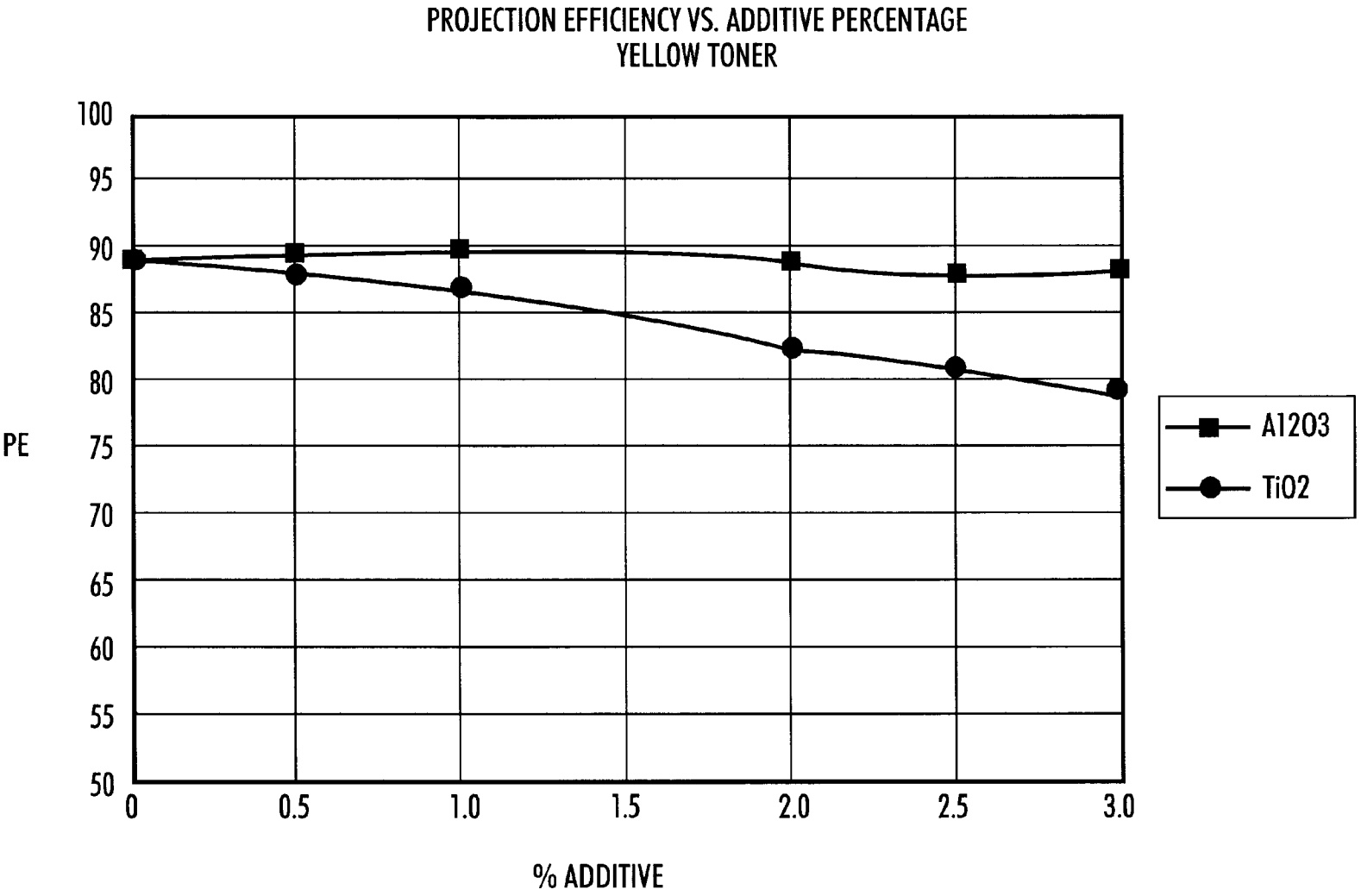
FIG. 2 shows projection efficiency as a function of additive percent for yellow developers of the present invention compared to conventional yellow developers.

Toners are made as in Example 1 and Comparative Example 1 except that the percent of additive is varied at values of 0%, 0.5%, 1%, 2%, 2.5% and 3%, by weight of the toner composition. Solid area images are made with these toners and fused using an envelope fuser. The images are then analyzed for their projection efficiency and color fidelity in the CIE LAB space. Projection efficiency is described as the amount of light that hits a detector within a 3.5 degree of arc perpendicular to the image versus all the light that passes through the image. The results are shown in FIG. 2. The results show that the surface treated alumina according to the present invention has little or no effect on projection efficiency to at least a loading of 3%, whereas surface treated titania used in conventional toners has a large detrimental effect on projection efficiency. The results in the table below indicate that treated alumina does not impair the color fidelity of an image, especially for high concentrations of additive as compared to $TiO_2$, (treated and untreated).

| | PE | L* | a* | b* | C* | h* |
|---|---|---|---|---|---|---|
| Control | 89.9 | 89.37 | 3.05 | 98.52 | 98.57 | 88.24 |
| 3.0% AlO2 | 88.5 | 89.23 | 2.78 | 97.62 | 97.65 | 88.37 |
| 3.0% TiO2 | 79.4 | 83.66 | 5.44 | 93.97 | 94.13 | 86.69 |

Comparative Example 9

Preparation of Magenta Toner

A toner is made by blending 88.25 weight percent of a polyester resin composed of bisphenol A and fumaric acid and 11.75 weight percent of a predispersion of the above mentioned polyester and 81:2 magenta pigment to give a final pigment concentration of 4.7 weight percent, and extruded in a ZSK-40 extruder. The extruded blend is then jetted and classified to form a magenta toner with a toner particle size of about 6.5 microns as measured in a Layson Cell. A thirty gram sample of this toner is added to a 9 ounce jar with 150 grams of stainless steel beads. To this is added 4.0 weight percent NA50HS, which is a 30 nanometer primary particle size fumed silica from Nippon Aerosil Corp., 2.5 weight percent SMT5103, which is a 30 nanometer primary particle size titanium dioxide coated with decylsilane generated from decyltrimethoxysilane available from Tayca Corp., and 0.3 weight percent zinc stearate L from Synthetic Products Company. After blending on a roll mill for 30 minutes the steel beads are removed from the jar.

Example 9

A magenta toner is prepared as in Comparative Example 9, except that the surface treated titania is replaced by a surface treated alumina, which is alumina treated with 15% decyltrimethoxysilane. The surface treated alumina is used in the same weight amount as the surface treated titania of Comparative Example 9.

Example 10 and Comparative Example 10

Developers are made using the toners of Example 9 and Comparative Example 9 by mixing 4 parts by weight of the foregoing blended toners with 100 parts by weight of a carrier of a Hoeganaes steel core, which core is previously coated with 1.0 weight percent of polymethylmethacrylate.

Figure 3:
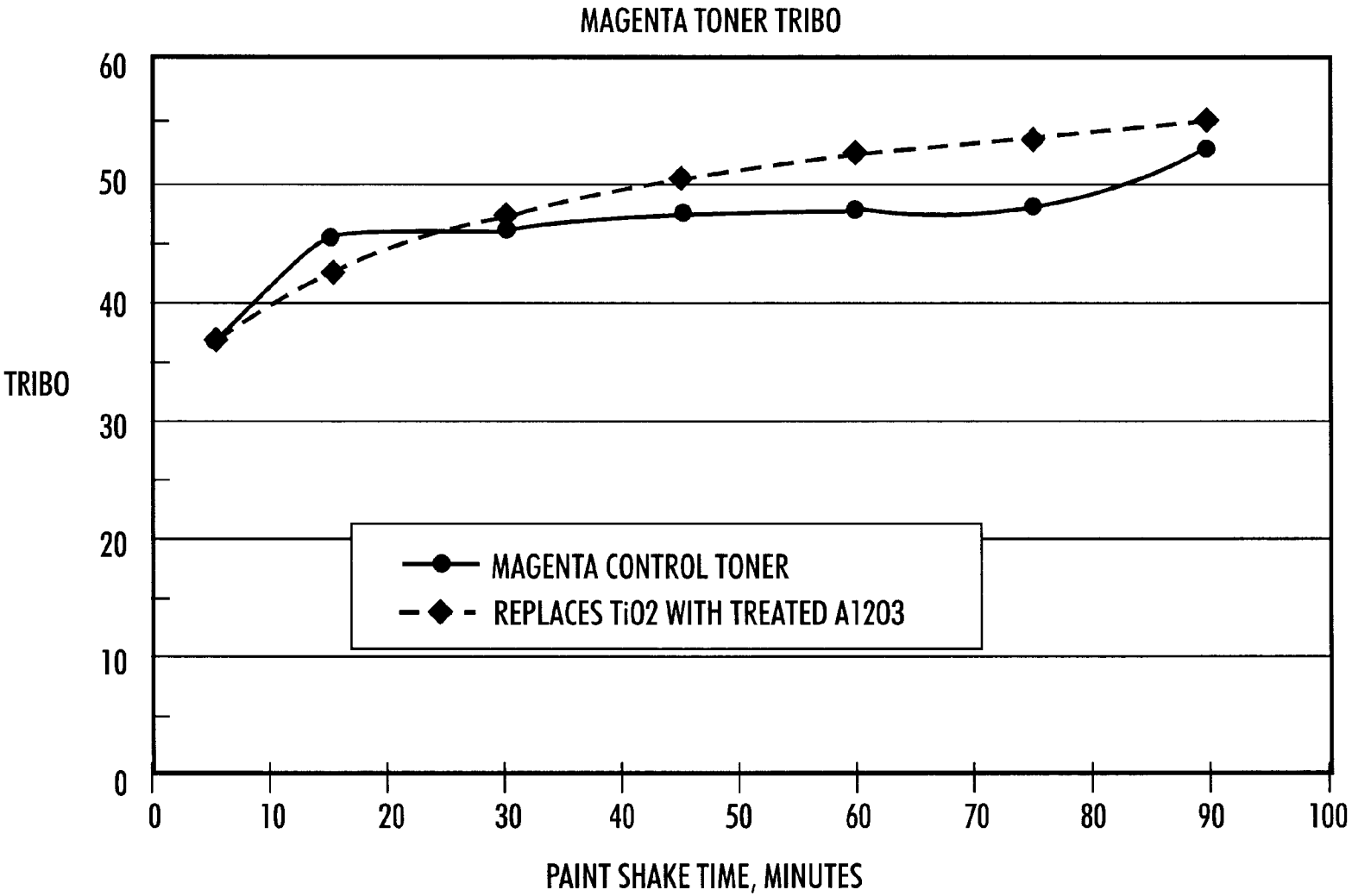
FIG. 3 shows triboelectric charge tracks for a magenta developer of the present invention compared to a conventional magenta developer.

A 90-minute triboelectric charge track is made for each of the developers. The tracks are shown in FIG. 3. The triboelectric charge tracks show that the toner composition of the present invention, including a surface treated alumina, is at least as good as the toner of Comparative Example 9, not including the surface treated alumina.

Admix testing of each of the developers is also performed. In admix testing, fresh blended toner is added to the developer used to measure the tribo time tracks. Samples of the developer are analyzed at time intervals of 15 seconds, 60 seconds, and 120 seconds after a 0 time sample. This test indicates the fresh toner's ability to charge the same as the old toner on the developer. The toner of Example 9 has very little wrong sign and low charge particles. Both the developers of Example 9 and Comparative Example 9 show high values of q/d (fc/$\mu$m) for their initial points of about 1.3 fc/$\mu$m. However, after the testing, the developer of Example 9 consistently shows better q/d values. By 120 seconds, the developer of Comparative Example 9 shows bimodal peaks with charge through, while the developer of Example 9 shows only a slight shoulder. The q/d value for Comparative Example 9 is 0.4, while the q/d value for Example 9 is 0.51.

Examples 11–16 and Comparative Example 11–16

Toners are made as in Example 9 and Comparative Example 9 except that the percent of additive is varied at values of 0%, 0.5%, 1%, 2%, 2.5% and 3%, by weight of the toner composition. Solid area images are made with these toners and fused using an envelope fuser. The Projection Efficiency is measured for each with results comparable to Examples 3–8 and Comparative Examples 3–8.

Comparative Example 17

Preparation of Cyan Toner

A toner is made by blending 89.0 weight percent of a polyester resin composed of bisphenol A and fumaric acid and 11.0 weight percent of a predispersion of the above mentioned polyester and 15:3 cyan pigment to give a final pigment concentration of 3.3 weight percent, and extruded in a ZSK-40 extruder. The extruded blend is then jetted and classified to form a cyan toner with a toner particle size of about 6.5 microns as measured in a Layson Cell. A thirty gram sample of this toner was added to a 9 ounce jar with 150 grams of stainless steel beads. To this is added 4.0 weight percent a 30 nanometer primary particle size fumed silica coated with decyltrimethoxysilane, available from Cabot Corp., 2.3 weight percent SMT5103, which is a 30 nanometer primary particle size titanium dioxide coated with decylsilane generated from decyltrimethoxysilane available from Tayca Corp., 0.2 weight percent H2050, which is a 12 nanometer primary particle size fumed silica commercially available from Wacker Chemie, and 0.3 weight percent zinc stearate L from Synthetic Products Company. After blending on a roll mill for 30 minutes the steel beads are removed from the jar.

Examples 17a and 17b

Two cyan toners are prepared as in Comparative Example 17, except that the surface treated titania is replaced by a surface treated alumina. In Example 17a, the surface treated alumina is alumina treated with 10% decyltrimethoxysilane. In Example 17b, the surface treated alumina is alumina treated with 15% decyltrimethoxysilane. The surface treated alumina is used in the same weight amount as the surface treated titania of Comparative Example 17.

Examples 18a and 18b and Comparative Example 18

Developers are made using the toners of Example 17a and 17b and Comparative Example 17 by mixing 4 parts by weight of the foregoing blended toners with 100 parts by weight of a carrier of a Hoeganaes steel core, which core is previously coated with 1.0 weight percent of polymethylmethacrylate.

Figure 4:
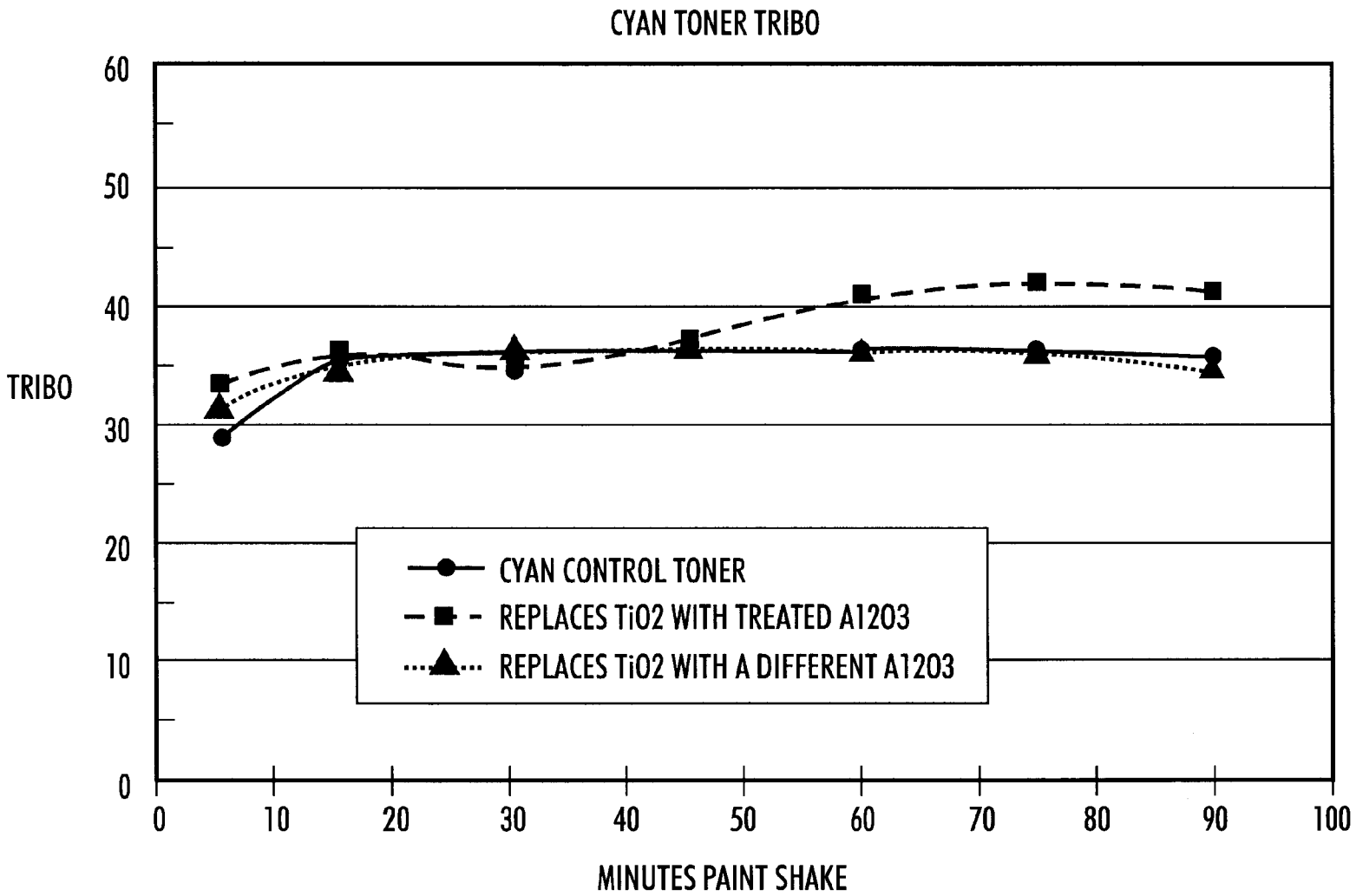
FIG. 4 shows triboelectric charge tracks for cyan developers of the present invention compared to a conventional cyan developer.

A 90-minute triboelectric charge track is made for each of the developers. The tracks are shown in FIG. 4. The triboelectric charge tracks show that the toner compositions of the present invention, including a surface treated alumina, are at least as good as the toner of Comparative Example 17, not including the surface treated alumina.

Admix testing of each of the developers is also performed. In admix testing fresh toner is added to the developer used to measure the tribo time tracks. Samples of the developer are analyzed at time intervals of 15 seconds, 60 seconds, and 120 seconds after a 0 time sample. This tests indicates the fresh toners ability to charge the same as the old toner on the developer. The toner of Example 17 has very little wrong sign and low charge particles. Both the developers of Example 17a and Comparative Example 17 show high values of q/d (fc/$\mu$m) for their initial points of about 1.1 fc/$\mu$m, while the developer of Example 17b shows a higher value of q/d (fc/$\mu$m) for its initial point of about 1.25 fc/$\mu$m. However, after the testing, the developers of Example 17a and 17b consistently show better q/d values. By 120 seconds, the developer of Comparative Example 17 shows strong bimodal peaks with charge through, while the developer of Example 17a remains unimodal, and the developer of Example 17b shows a bimodal peak, but smaller than that of Comparative Example 17. The q/d value for Comparative Example 17 is about 0.4, while the q/d value for Examples 17a and 17b are about 0.8 and about 0.25, respectively.

Examples 19–24 and Comparative Example 19–24

Toners are made as in Example 17 and Comparative Example 17 except that the percent of additive is varied at values of 0%, 0.5%, 1%, 2%, 2.5% and 3%, by weight of the toner composition. Solid area images are made with these toners and fused using an envelope fuser. The Projection Efficiency is measured for each, with results comparable to Examples 3–8 and Comparative Examples 3–8.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

What is claimed is:

1. A toner composition comprising:

a binder, a colorant, and a treated alumina, wherein said treated alumina comprises alumina particles treated with a treatment agent, and said treatment agent is decylalkoxysilane, and wherein said treated alumina has a primary particle size of from about 25 to about 55 nanometers, and an average aggregate size of from about 190 to about 400 nanometers.

2. A toner composition in accordance with claim 1 wherein said treatment agent is present in an amount from about 2 to about 25 weight percent, based on a weight of the alumina particles.

3. A toner composition in accordance with claim 1 wherein an amount of said treatment agent is determined from a feed rate or feed amount of said treatment agent, and which amount is from about 5 to about 25 weight percent.

4. A toner composition in accordance with claim 1 wherein the presence of the treated alumina does not cause light scattering of a color image formed on a transparency using the toner composition.

5. A toner composition in accordance with claim 1 wherein the presence of the treated alumina does not cause a change in color fidelity of an image formed on a transparency using the toner composition, as measured in the CIE LAB color space.

6. A toner composition in accordance with claim 1 further comprising a wax.

7. A toner composition in accordance with claim 1 wherein the colorant is selected from the group consisting of cyan, magenta, yellow, red, orange, green, and violet.

8. A toner composition in accordance with claim 1 wherein said treated alumina is present in an amount of from about 0.5 weight percent to about 6 weight percent by weight of the toner composition.

9. A toner composition in accordance with claim 1 wherein the toner composition has a triboelectric charge of from about 15 to about 65 microcoulombs per gram.

10. A toner composition in accordance with claim 1 wherein the toner composition has an admix time of from about 1 second to about 60 seconds.

11. A developer comprising:

the toner composition of claim 1, and a carrier.

12. A process for the preparing a toner composition, comprising:

mixing a resin, and a colorant to form toner particles, and applying to an external surface of said toner particles, a treated $Al_2O_3$ comprising alumina particles treated with a treatment agent, and said treatment agent is decylalkoxysilane, wherein said treated alumina has a primary particle size of from about 25 to about 55 nanometers, and an average aggregate size of from about 190 to about 400 nanometers.

13. A process in accordance with claim 12 wherein said treatment agent is decyltrimethoxysilane.

14. A toner composition in accordance with claim 1 wherein said treatment agent is decyltrimethoxysilane.

* * * * *